US010047940B2

(12) United States Patent
Grunzweig et al.

(10) Patent No.: US 10,047,940 B2
(45) Date of Patent: Aug. 14, 2018

(54) REMOVABLY CONNECTABLE UNITS FOR POWER, LIGHT, DATA, OR OTHER FUNCTIONS

(71) Applicants: Dawson I. Grunzweig, Great Falls, MT (US); Justin Sowa, Great Falls, MT (US)

(72) Inventors: Dawson I. Grunzweig, Great Falls, MT (US); Justin Sowa, Great Falls, MT (US)

( * ) Notice: Subject to any disclaimer, the term of this patent is extended or adjusted under 35 U.S.C. 154(b) by 0 days.

(21) Appl. No.: 15/137,771

(22) Filed: Apr. 25, 2016

(65) Prior Publication Data

US 2017/0023219 A1 Jan. 26, 2017

Related U.S. Application Data

(60) Provisional application No. 62/152,879, filed on Apr. 25, 2015.

(51) Int. Cl.

| | |
|---|---|
| ***F21V 23/00*** | (2015.01) |
| ***A63H 33/04*** | (2006.01) |
| ***F21S 2/00*** | (2016.01) |
| ***F21V 21/096*** | (2006.01) |
| ***F21V 23/04*** | (2006.01) |
| *F21Y 115/10* | (2016.01) |
| *F21Y 113/13* | (2016.01) |
| *F21V 33/00* | (2006.01) |

(52) U.S. Cl.

CPC ..... *F21V 23/002* (2013.01); *A63H 33/042* (2013.01); *A63H 33/046* (2013.01); *F21S 2/00* (2013.01); *F21V 21/096* (2013.01); *F21V 23/003* (2013.01); *F21V 23/0435* (2013.01); *F21V 33/0056* (2013.01); *F21V 33/0096* (2013.01); *F21Y 2113/13* (2016.08); *F21Y 2115/10* (2016.08)

(58) Field of Classification Search

CPC .... F21V 21/096; F21V 23/002; F21V 23/003; F21V 23/0435; F21V 33/0056; F21V 33/008; F21V 33/0096; F21S 2/00; F21S 2/005; A63H 33/042; A63H 33/046

See application file for complete search history.

(56) References Cited

U.S. PATENT DOCUMENTS

| | | | | |
|---|---|---|---|---|
| 3,696,548 | A * | 10/1972 | Teller | A63H 33/042 446/91 |
| 4,413,311 | A | 11/1983 | Orenstein | |
| 4,532,579 | A | 7/1985 | Merryman | |
| 5,378,552 | A | 1/1995 | Dixon, Jr. | |
| 6,422,716 | B2 | 7/2002 | Henrici et al. | |
| 6,629,771 | B2 | 10/2003 | Chiu | |
| 7,080,927 | B2 | 7/2006 | Feuerborn et al. | |
| 7,846,002 | B1 * | 12/2010 | Mikesell | A63H 33/042 446/91 |
| 8,231,261 | B2 | 7/2012 | Gherardini et al. | |
| 8,232,745 | B2 | 7/2012 | Chemel et al. | |
| 8,310,175 | B2 * | 11/2012 | Van Endert | F21S 2/005 257/99 |
| 2003/0142499 | A1 | 7/2003 | Chiu | |

(Continued)

*Primary Examiner* — Alexander Garlen

(74) *Attorney, Agent, or Firm* — Dicke, Billig & Czaja, PLLC

(57) ABSTRACT

Multiple units are removably connectable to provide desired functions, such as light, power, data, or other functions.

20 Claims, 9 Drawing Sheets

(56) References Cited

U.S. PATENT DOCUMENTS

| | | | | |
|---|---|---|---|---|
| 2003/0148700 | A1* | 8/2003 | Arlinsky | A63H 33/04 446/91 |
| 2006/0134978 | A1* | 6/2006 | Rosen | A63H 33/042 439/581 |
| 2010/0244692 | A1* | 9/2010 | Van Endert | F21S 2/005 315/32 |
| 2010/0296285 | A1 | 11/2010 | Chemel et al. | |
| 2011/0074833 | A1* | 3/2011 | Murayama | A63H 33/042 345/690 |
| 2011/0211344 | A1 | 9/2011 | Harbers et al. | |
| 2011/0317391 | A1* | 12/2011 | Peng | A63H 33/046 361/809 |
| 2012/0140474 | A1 | 6/2012 | Jurik et al. | |
| 2012/0208378 | A1 | 8/2012 | Rudisill et al. | |
| 2013/0109267 | A1* | 5/2013 | Schweikardt | A63H 33/04 446/85 |
| 2013/0127828 | A1* | 5/2013 | Li | G06F 3/0354 345/419 |
| 2013/0163234 | A1* | 6/2013 | Hsien | F21S 2/005 362/190 |
| 2013/0163235 | A1* | 6/2013 | Chuang | F21V 15/01 362/190 |
| 2013/0279179 | A1 | 10/2013 | Pearson et al. | |
| 2014/0213140 | A1* | 7/2014 | Goh | G06F 3/002 446/175 |
| 2014/0349544 | A1* | 11/2014 | Chien | A63H 33/042 446/91 |
| 2016/0101370 | A1* | 4/2016 | Madsen | A63H 33/042 446/91 |
| 2016/0310861 | A1* | 10/2016 | Hirata | A63F 13/327 |
| 2016/0339351 | A1* | 11/2016 | Akishbekov | A63H 33/042 |

* cited by examiner

REMOVABLY CONNECTABLE UNITS FOR POWER, LIGHT, DATA, OR OTHER FUNCTIONS

CROSS-REFERENCE TO RELATED APPLICATIONS

This Utility Patent Application is a Non-Provisional Application of U.S. Provisional Application 62/152,879, entitled: LIGHTING UNIT, filed Apr. 25, 2015, incorporated by reference herein.

BACKGROUND

Traditional lighting typically involves stationary mounting on a ceiling or wall or involves a bulky support for non-stationary lighting, such as a desktop lamp.

DETAILED DESCRIPTION

Figure 1B:
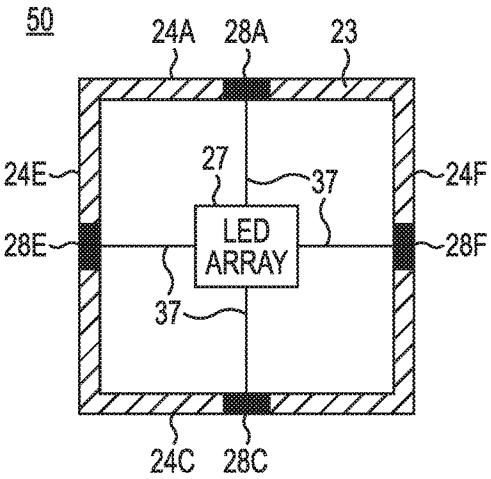
FIG. 1B is a diagram including a sectional view schematically representing a lighting unit containing an LED, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

In at least some examples of the present disclosure, single-function units and/or multi-function units can be assembled together into multiple configurations via removable connection of the units relative to each other. In some examples, at least some of the units include a housing defining a box or cube. In some examples, a particular type of unit may be referred to according to at least one of the particular types of functionality (e.g. lighting unit, audio unit, etc.) provided via that unit.

In some examples, a housing of at least some of the units are constructed through the process of 3D printing.

In some examples, magnetic contacts are affixed within the faces of a housing of each respective unit to provide the pathway for electricity to flow as well as the method for attachment. Accordingly, in some examples, the mechanism providing magnetic attraction between adjacent units provides transmission of electrical conductivity for transmitting/receiving power and/or signals, data, etc. between adjacent units.

In some examples, a change in the orientation of the units will change the orientation of the contacts of one unit relative to another adjacent (magnetically coupled) unit (or relative to a base) and therefore change the color or the function of the rest of the series (e.g. chain) of units. In some examples, this arrangement allows custom color patterns among the units to be created and in which the overall color scheme can be changed at the base station.

In some examples, a lighting unit comprises a multi-color light source enclosed within its housing. In some examples, the multi-color light source comprises a RGB LED package or a RGBW LED package. In some examples, the light source is a single color light source.

In some examples, a housing of at least some of the units include at least some faces which are clear, i.e. lacking color. In some examples, a housing of at least some of the units include at least some faces which have color. In some examples, a housing of at least some of the units include at least some faces which are transparent, translucent, or opaque.

As noted above, in some examples in which the housing of at least some units enclose a multi-color light source, a rotation of at least one of the units within a series (or other non-linear configuration) of units will result in a change of color in the adjacent units which are "downstream" from the power source and the "rotated" unit (within the series of units).

In some examples, at least some of the units within a series of units comprise a fan, audio device, and/or USB charging mechanism.

In some examples, via such arrangements a consumer is able to express their creativity in an object as simple as a configurable lighting, a lamp or fan. Such arrangements enable a user to exhibit considerable creativity and functionality from such removably connectable units. There can be seemingly endless possibilities when it comes to the placement of the units relative to each other and the colors chosen, such as examples when a lighting functionality is implemented. In one aspect, this arrangement enables expression of the individual creativity of the consumer.

In some examples, a base portion (to which a first unit is removably coupled) enables controlling various functions of one or more units. In some examples, such functions include a brightness of a lighting unit, a change of color of one or more lighting units. In some examples, such functions include a fan speed of a housing including a fan. In some examples, such functions include a volume of an audio function provided via a speaker or other audio emission mechanism as a portion of a housing.

In some examples, a housing of at least some of units comprise the same size. In some examples, a housing of at least some of the units comprise different sizes and/or different shapes.

Accordingly, in some examples, via these arrangements a user is not limited to the shape, color or function of a simple lamp or electronic device. Instead, they may make any configuration from the units that they desire and add function as well as creativity. The arrangements may be embodied in a variety of differently sized and/or differently shaped housings, which can be combined in a variety of different configurations.

In some examples, the base and/or some units incorporate wireless internet communication functionality, which enable wireless customization, control, and notifications as well as connection to the developing internet of things (IoT). In some examples, at least one of the units (or a base to support the units) is controllable via the web or via an "app" on a mobile computing device (e.g. phone, tablet, phablet, etc.).

In some examples, at least one of the units (or a base to support the units) supports electronically receiving notifications and communicating the notifications via color, sound, or other functions expressible via the units.

These examples, and additional examples are further described below in association with at least FIGS. 1A-21.

Figure 1A:
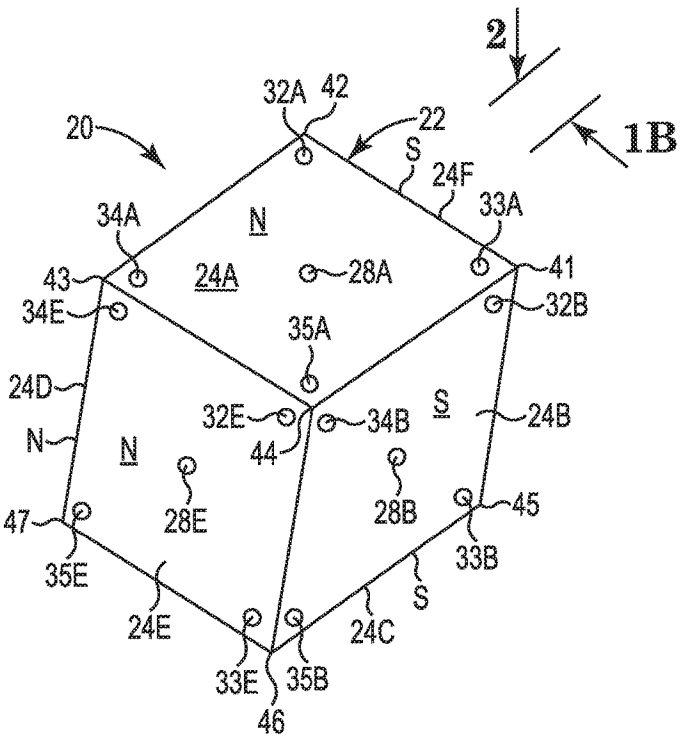
FIG. 1A is a perspective view schematically representing a removably connectable unit, according to one example of the present disclosure.

FIG. 1A is perspective view schematically illustrating a unit 20, according to one example of the present disclosure. As shown in FIG. 1A, unit 20 includes a generally rectangular-shaped housing 22 defining six faces 24A-24F and corners (e.g. 41, 42, 43, etc.). In some examples, at least some of the faces of a single housing 22 are oriented generally perpendicular to each other while being generally parallel to other faces of the same housing 22.

In some examples, each face includes multiple conductive contacts, such as conductive contacts 32A-35A on face 24A, conductive contacts 32B-35B on face 24B, and so on. In some instances, when equipped with such conductive contacts, a face is sometimes referred to as a contact interface.

In some examples, a unit 20 can be employed with one or several different functionalities of a plurality of functionalities, such as lighting, power, data, audio, fan, etc. as described throughout the examples of the present disclosure.

In some examples, such as when a unit(s) 50 comprise lighting functionality, the conductive contacts are arranged in at least a first pattern in which each respective one of the conductive contacts (e.g. 32A, 33A, 34A, 35A) on a respective face (e.g. 24A) of housing 22 corresponds to a respective one of a plurality of different colors of the multi-color light source. For instance, in one example conductive contact 32A would correspond to the color Red, the conductive contact 33A would correspond to the color Blue, the conductive contact 34A would correspond to the color Green, and the conductive contact 35A would correspond to White.

With this arrangement, upon application of power to the respective conductive contact, a corresponding color is emitted from the multi-color light source (e.g. LED array 27 in FIGS. 1B, 2). Following the just one example above, applying power to conductive contact 32A would cause the housing to emit Red light. Applying power to more than one conductive contact (e.g. 32A, 33A, 34A, 35A) would cause the housing to emit light in a combination of the colors.

Each face also includes a common conductor (e.g. ground) 28A for face 24A, 28B for face 24B, and so on. All of the common conductors are electrically connected together.

In some examples in which unit 20 has lighting functionality, while not shown in FIG. 1A, housing 22 contains or encloses a multi-color light source. In some examples, this light source includes a multi-color light emitting diode (LED) array 27, such as shown in FIG. 1B. In some examples, the LED array 27 includes multiple separate diodes, one for each color. In some examples, a single LED circuit package is able to provide illumination in multiple colors, such as Red, Green, Blue, or White, or combinations thereof. By selecting or adjusting which color is activated, and its relative intensity, one can cause the light source to produce the desired color and brightness of illumination.

In some examples, a wall 23 (FIG. 1B) defining housing 22 is translucent and in some examples, the wall 23 is transparent. In some examples, wall 23 is opaque. In some examples, the housing 22 is formed from molding or 3D printing using any one of various materials suitable for those techniques. In some examples, the material forming housing 22 is a dielectric or electrically insulative material.

Figure 1C:
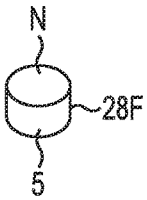
FIG. 1C is a diagram schematically representing a magnetic contact element, according to one example of the present disclosure.

In some examples, the conductive contacts (e.g. 32A-35A) for a particular face are generally disc-shaped elements as shown in FIG. 1C, and are magnetized with an orientation of North on one flat, planar side of the element and South on the opposite, planar side of the element.

With further reference to FIG. 1A, in some examples all conductive contacts for a particular face, are oriented in the same direction, such as the conductive contacts 32A-35A on face 24A having their North surface (represented by N) oriented outward such that face 24A, as shown in FIG. 1A. With this in mind, in some examples three of six faces of the cube-shaped housing 22 have the same magnetic orientation (e.g. North on faces 24A, 24D, and 24E) while the other respective three of six faces have an opposite orientation (e.g. South on faces 24B, 24C, 24F). Among other aspects, this arrangement facilitates releasably securing adjacent units together with at least some of the conductive contacts of one unit 20 becoming magnetically attracted and secured relative to the conductive contacts of an immediately adjacent second unit.

In some examples, the first pattern of conductive contacts (e.g. 32A-35A on face 24A, 32B-35B on face 24B, and so on) includes placing the conductive contacts at the four corners of the particular face. When releasably connected (via magnetic attraction) to a similarly arranged pattern of conductive contacts of a face of an adjacent lighting unit, this "four corner" pattern yields a strong, stable mechanical connection between the respective housings 22 of adjacent lighting units 20. However, it will be understood that in some examples, such conductive contacts may be arranged in other shaped patterns.

With continued reference to FIG. 1A, in some examples the common conductive contacts (e.g. ground) such as contacts 28A-28F are each located at a center of their respective faces. With this arrangement, when a particular unit 20 is releasably connected (via magnetic attraction) between the "four corner" conductive contacts of the abutting respective faces of the adjacent units 20, a rotation (e.g. 90 degrees, 180 degrees, etc.) of the housing 22 of one of the units would not affect a similar releasable connection between the centrally located common conductor contacts of abutting faces of adjacent units 20.

In some examples, unit 20 comprises lighting functionality. Accordingly, FIG. 1B is a diagram 50 including a sectional view as taken along lines 1B-1B in FIG. 1A, and schematically illustrates one example implementation in which a unit 20 comprises lighting functionality via a LED array 27 enclosed within wall 23 of housing 22. Connectors 37 provide electrical communication between a ground pin of the LED array 27 and each respective common conductor 28A, 28C, 28E, 28F. Similar connections are made between common conductors 28B, 28D and LED array 27 as shown later in association with at least FIG. 2A, which is a sectional view as taken along lines 2-2 in FIG. 1A.

Figure 2A:
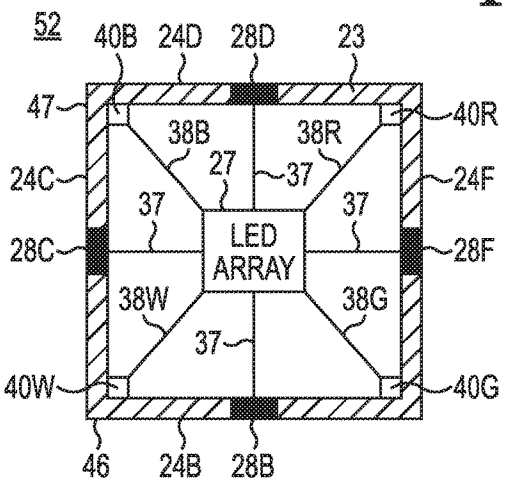
FIG. 2A is a diagram including a sectional view schematically representing a lighting unit containing an LED, according to one example of the present disclosure.

As further shown in the diagram 52 in FIG. 2A, and according to one example of the present disclosure, each of the different colors of the LED array 27 are connected to a node at two opposite corners of the rectangular-shaped housing 22. For example, via connector 38B the color Blue of LED array 27 is connected to node 40B, such as at corner 47 of housing 22. Via connector 38W the color White of LED array 27 is connected to node 40W, such as at corner 46 of housing. As further shown in FIG. 2A, connectors 38R, and 38G provide similar functions for the colors Red and Green of the LED array 27, respectively. It will be understood that in some examples, color White is provided by a separate diode from a package diode that provides the colors Red, Green, and Blue.

In some examples, the LED array 27 is centrally located within the rectangular housing 22 to facilitate routing of the respective connectors in an efficient and effective pattern permitting a single color to be connected to nodes at opposite diagonal corners of the housing 22.

Figure 2B:
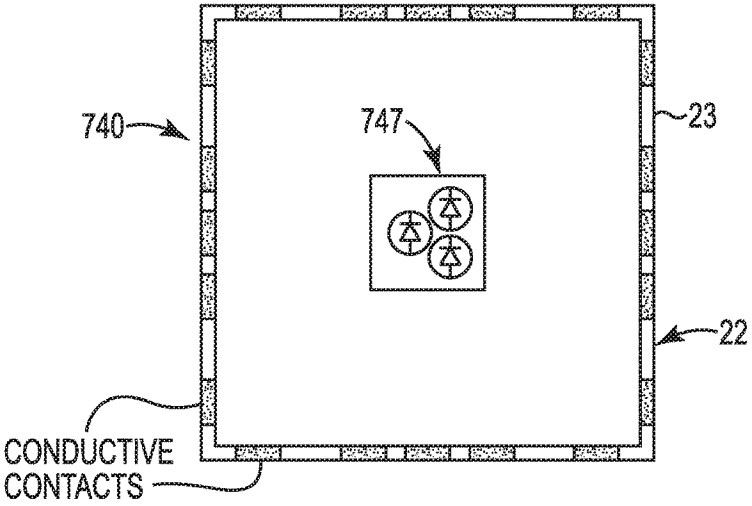
FIG. 2B is a diagram including a sectional view schematically representing a lighting unit containing an LED, according to one example of the present disclosure.

One example of such an LED package 747, as mounted within a housing of a lighting unit, is illustrated in association with at least FIG. 2B.

Figure 3A:
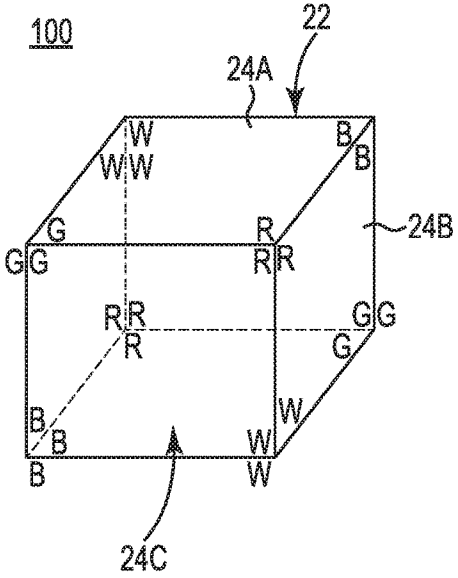
FIG. 3A is a diagram including a perspective view schematically representing a lighting unit, according to one example of the present disclosure.
Figure 3B:
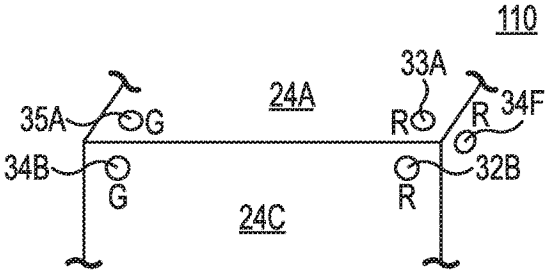
FIG. 3B is a diagram including a partial perspective view schematically representing a lighting unit, according to one example of the present disclosure.

FIGS. 3A-3B are each diagrams (100, 110 respectively) including a perspective view schematically illustrating one example of how each corner of a unit 20 with lighting functionality includes conductive contacts which are color-assigned (Red—R, Green—G, Blue—B, or White—W) via connection to the centrally located LED array 27 (FIG. 1B) with the same color being present at opposite corners. For instance, FIG. 3B depicts conductive contacts 33A, 34F, and 32B being assigned Red, which is implemented via their common electrical connection to the Red portion of LED array 27, while conductive contacts 35A, 35B etc. are assigned Green, and so on . . . .

Figure 4:
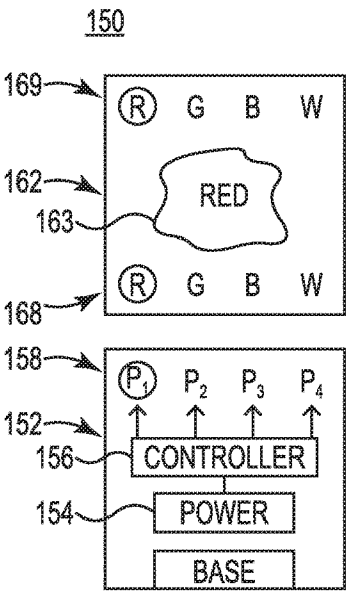
FIG. 4 is a diagram including a side view schematically representing activation of a lighting unit via a base, according to one example of the present disclosure.

FIG. 4 is diagram 150 schematically illustrating releasable connection and interaction between a base 152 and lighting unit 162, according to one example of the present disclosure. In some examples, lighting unit 162 comprises at least some of substantially the same features and attributes as units 20 generally and units 20 with lighting functionality, as previously described herein.

As shown in FIG. 4, base 152 has a control contact interface 158 having an array of individually addressable conductive power contacts (P1, P2, P3, P4) arranged in a pattern which at least matches a pattern of conductive contacts (labeled R, G, B, W) of a contact interface of the lighting unit 162. In some examples, each respective one of the conductive power contacts (P1, P2, P3, P4) corresponds to a respective one of a plurality of different colors (Red [R], Green [G], Blue [B], White [W]) of the multi-color light source (e.g. LED array 27 in FIG. 1B). With this arrangement, upon application of power via the base 152 to selected conductive power contacts (P1-P4), power will be transmitted to the corresponding contact of the first contact interface 168 of lighting unit 162. It will be understood that at least some of the conductive power contacts (P1, P2, P3, P4) are magnetically attractable relative to the magnetically attractable conductive contacts of the first control interface 168 of lighting unit 162. It will be understood that a ground path will be incorporated to enable power and/or data flow, with at least one example implementation of a ground being described in association with at least FIGS. 1A-2A, 5, 12D, etc.

For instance, upon power (via power unit 154) being applied (as represented by a circle about the symbol "P1") from base 152 to a conductive contact corresponding to Red in contact interface 168 (as represented by the encircled symbol "R"), lighting unit 162 will exhibit a red illumination 163. In addition, other conductive contacts coupled to the Red portion of the LED array 27 will be in a "powered" state, as shown via contact interface 169, which is exposed for potential releasable connection to other connectable lighting units.

As further shown in FIG. 4, in some examples base 152 includes a controller 156 to enable selective application of power (from power unit 154) to the respective power contacts P1-P4. In some examples, as further described within the present disclosure, controller 156 provides additional functions. In some examples, controller 156 comprises at least some of substantially the same features and attributes as control portion 300 (including controller 302), as later described in association with at least FIG. 10.

Figure 21:
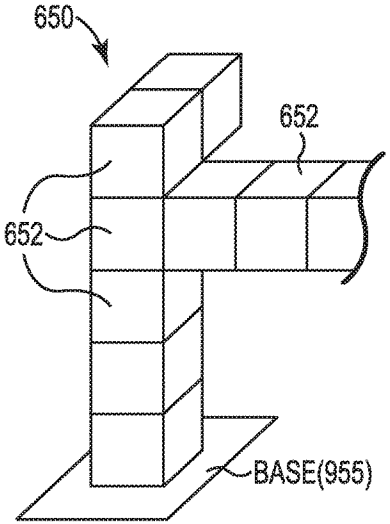
FIG. 21 is a perspective view schematically representing an assembly of multiple units removably connected together, according to one example of the present disclosure.

In some examples, in association with controller 156, the power unit 154 may provide variable power and adjust power according to the number of units 162 (which is one example of a unit 20 in FIG. 1A) connected together relative to base 152. Via this arrangement, one need not perform manual data entry or manual manipulation of user controls in order to adjust the power to accommodate a variable number of lighting units (or other types of units later described) as they are selectively added or subtracted from a chain of such units extending from base 152. FIG. 21 provides just one example of a chain of such units connected together relative to a base.

Figure 5:
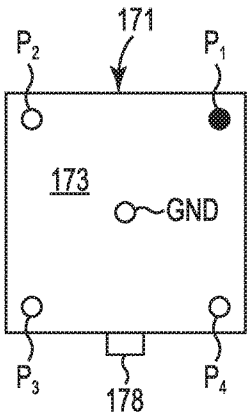
FIG. 5 is a diagram including a top view schematically representing a base, according to one example of the present disclosure.

FIG. 5 is a top plan view of a control contact interface 171 of base 152, according to one example of the present disclosure. In some examples, control contact interface 171 provides just one example of control contact interface 158 shown in FIG. 4.

As shown in FIG. 5, control contact interface 171 has a pattern of power contacts P1-P4 in a generally rectangular shape to generally match the pattern of conductive contacts (e.g. 32A-35A on face 24A in FIG. 1A) on each face of a lighting unit, along with a matching, centrally located common conductor contact (GND). Each power contact P1-P4 is magnetically attractable relative to the conductive contacts of the lighting unit 162. As shown in FIG. 5, power contact P1 is represented as being in a "powered-on" state via being blackened, whereas the other power contacts P2-P4 are represented in this Figure as being in a "non-powered" state.

In some examples, control contact interface 171 of base 152 (or some other portion of base) includes a registration element 178 to ensure alignment and registration relative to a corresponding feature on the lighting unit 162. Via such registration elements, the particular color-assigned conductive contacts of the faces of the lighting unit 162 (e.g. 22 in FIG. 1A) become automatically matched with the particular power contacts P1-P4 of the base 152 intended to activate a particular color. For instance, the power contact P1 may be assigned to activate Red, such that the registration element 178 ensures that the conductive contact connected to the Red light of the LED array 27 will become releasably coupled to the power contact P1. In some examples, the registration element 178 is a mechanical element which provides a releasable mating or locking function, while in some examples, the registration element 178 is a symbolic element facilitating alignment but not providing a releasable mating or locking function. In some examples, the registration element 178 is a combination of mechanical elements and symbolic elements.

In some examples, this arrangement enables a user interface associated with the controller 156 to select and control which color(s) of a lighting unit will be activated alone or in combination.

Figure 6B:
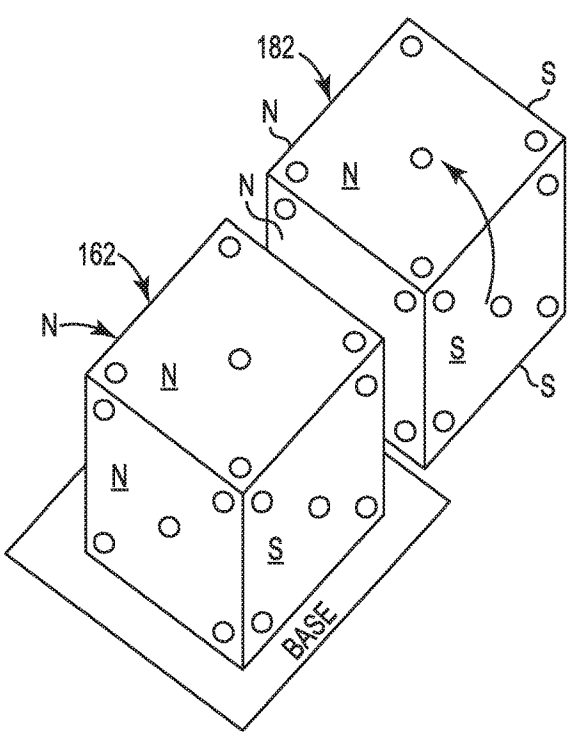
FIG. 6B is a diagram including a perspective view schematically representing activation of multiple removably connected lighting units relative to a base, according to one example of the present disclosure.
Figure 6A:
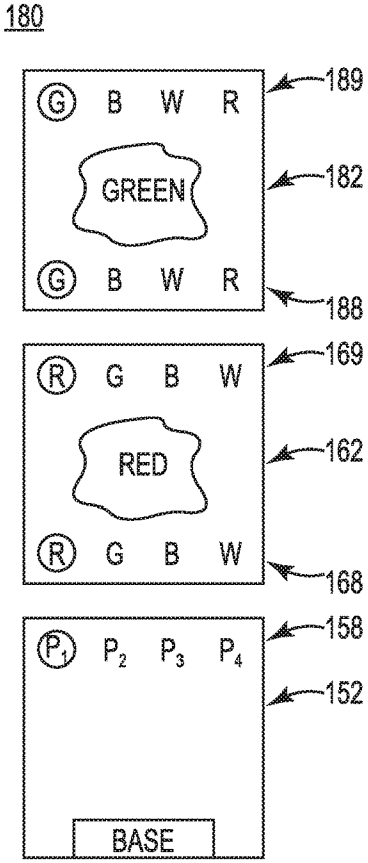
FIG. 6A is a diagram including a side view schematically representing activation of multiple removably connected lighting units relative to a base, according to one example of the present disclosure.

FIG. 6A is diagram 180 like diagram 150, except schematically illustrating the addition (via releasable connection per magnetic attraction) of a second lighting unit 182 in series with lighting unit 162. It will be understood that the term "series" in this context refers to the adjacent physical position of the respective units and does not refer to the electrical principles by which the respective units are electrically coupled relative to each other, which in some instances may be in parallel.

In this instance the lighting unit 182 has been rotated as shown schematically in FIG. 6B (or initially deployed) to align its Green-assigned conductive contact of contact interface 188 (on at least one face of the lighting unit 182, as represented by encircled "G" in FIG. 6A) with the powered, Red-assigned conductive contact (on at least one face) of lighting unit 162. In this instance, the power from lighting unit 162 is transmitted to lighting unit 182 thereby causing the lighting unit 182 to emit Green light.

With this in mind, in some examples a user may simply rotate the second lighting unit 182 at 90 degree rotations in order to change the color emitted by second lighting unit 182 between Red, Green, Blue, and White. Of course, when more than one power contact (e.g. P1-P4) of the base is activated, other colors are producible by lighting unit 162, and further color variations will be observed at lighting unit 182 upon each repositioning or rotation of lighting unit 182.

In some examples, instead of using a controller (e.g. 156) to change a color of a first lighting unit 162, a user changes the color of lighting unit 162 via simply rotating the first lighting unit 162 relative to the base 152, thereby changing which respective conductive contacts of the lighting unit 162 become "powered-on" via the respective "powered-on" power contacts P1-P4 of the control contact interface 158 (171 in FIG. 5). In some such examples, the registration element 178 is omitted or configured in a manner to enable free discretionary rotation of lighting unit 162 relative to base 152.

With regard to the examples associated with FIGS. 4-6B, it will be understood that in some examples the arrangement of base 152 to support units 162, 182 also apply to units 20, 162, 182 which omit lighting functionality and which may include one or more of other types of functionality, as described throughout examples of the present disclosure.

In some examples, base 152 is portable and can be removably affixed or removably set on a support element, while in some examples base 152 is permanently mounted relative to support element or surface, such as a ceiling, wall, floor, portion of furniture, portion of automobile, etc.

Figure 7:
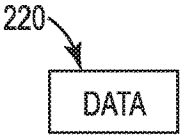
FIG. 7 is a block diagram schematically representing a data module, according to one example of the present disclosure.

FIG. 7 is a block diagram schematically illustrating a data module 220, according to one example of the present disclosure. In some examples, data module 220 may be implemented in base 152 (FIG. 4) to enable transmission and reception of data to and from the respective units removably coupled to base 152, as well as transmission and reception of data to and from other devices external to base 152, such as noted below with respect to communication module 230. In some examples, data module 220 is implemented in at least some of the unit(s) 20, 162, 182.

Figure 8:
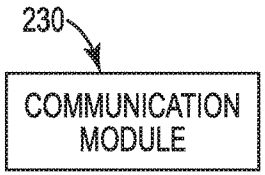
FIG. 8 is a block diagram schematically representing a communication module, according to one example of the present disclosure.

FIG. 8 is a block diagram schematically illustrating a communication module 230, which may in some examples, comprise wired or wireless communication elements for incorporation into base 152, and by which base 152 may communicate with external devices, such as mobile computing devices (including smart phones, tablets, etc.) desktop computers, etc. to feed data to base 152 and/or to at least partially externally control base 152.

In some examples, via a communication module 230, the base 152 and/or some units (e.g. 20, 162, 182) incorporate wireless internet communication functionality, which enable wireless customization, control, and notifications as well as connection to the developing internet of things (IoT). In some examples, via a communication module 230, at least one of the units (or a base to support the respective units) is controllable via the web or via an "app" on a mobile computing device (e.g. phone, tablet, phablet, etc.).

In some examples, via data module 220 and/or communication module 230, base 152 and/or at least one of the units 162, 182 may electronically receive notifications and communicating the notifications via color, sound, or other functions expressible via the units.

In some examples, at least some of substantially the same features and attributes of such communication modules 230 are implemented within at least some of the units 162, 182, whether such units have lighting functionality and/or other types of functionality. Accordingly, in some examples, such communication modules 230 are implemented within some units 162, 182 which omit lighting functionality, and which may or may not include one or more of the other types of functionalities (e.g. audio, data, etc.) described throughout the present disclosure.

In some examples, base 152 and/or at least some units include both data module 220 and communication module 230.

Figure 9:
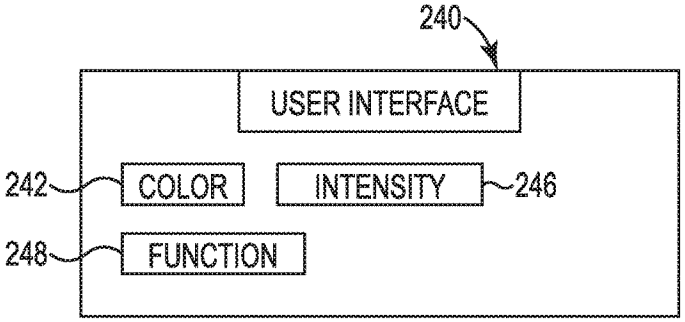
FIG. 9 is a block diagram schematically representing a user interface, according to one example of the present disclosure.

In some examples, as shown in FIG. 9, a user interface 240 is associated with base 152 to control base 152, and thereby control illumination (and/or other functions) of the respective units 162 removably coupled to base 152. In some examples, user interface 240 may be located on or at base 152 or which may be located in a dedicated remote control or via a mobile computing device (e.g. phone, tablet, phablet, etc.). When located at base 152, the user interface 240 may include mechanical inputs such as potentiometers and/or may include a graphical user interface. As shown in FIG. 9, in some examples user interface 240 includes a color parameter 242 to select a particular color to be emitted from at least one lighting unit 162. Such colors may be one of the primary colors (R, G, B, W) producible by the LED array 27 or any combination of such colors, as at least partially implemented via intensity parameter 246 which enables selection and implementation of the intensity (e.g. brightness) of each particular primary color (e.g. on a scale of 0 to 255). In some examples, such color selection is implemented via controlling power to selectable power contacts P1-P4 (FIGS. 4, 5) in any desired combination, including but not limited to, powering just a single power contact.

As further shown in FIG. 9, in some examples user interface 240 includes a function parameter 248 to enable user selection of various functions controllable via base, and as further described later in association with at least FIGS. 11-15B, with some of those functions being non-lighting functions.

Figure 10:
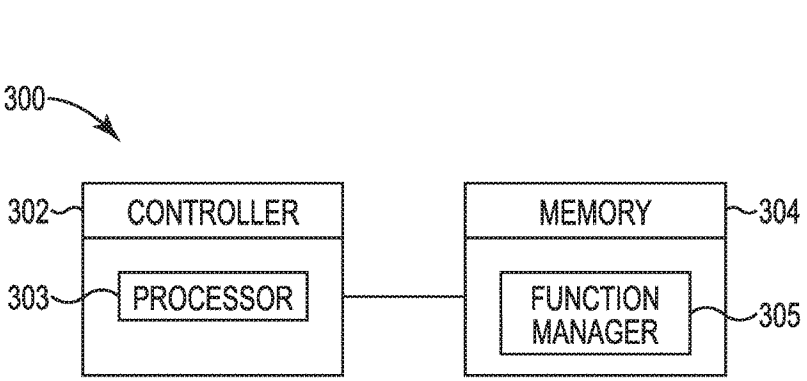
FIG. 10 is a block diagram schematically representing a control portion, according to one example of the present disclosure.

FIG. 10 is a block diagram schematically illustrating a control portion 300, according to one example of the present disclosure. In some examples, control portion 300 includes a controller 302 and a memory 304.

In general terms, controller 302 of control portion 300 comprises at least one processor 303 and associated memories that are in communication with memory 304 to generate control signals to direct operation of at least some components of the systems and components described throughout the present disclosure. In some examples, these generated control signals include, but are not limited to, employing function manager 305 to manage color illumination and/or other functions, such as power, data, audio, etc. as described throughout examples of the present disclosure.

In some examples, function manager 305 is a dedicated color manager to control the selection of color(s) and/or brightness of colors in the various lighting units 20 (e.g. 162 in FIG. 4) removably connected to the base (e.g. base 152 in FIG. 4).

In response to or based upon commands received via a user interface (e.g. user interface 240 in FIGS. 9, 11 or user interface 495 in FIG. 16B) and/or via machine readable instructions (including software), controller 302 generates control signals to implement color illumination management via base 152 and/or to control other non-illumination functions later described examples of the present disclosure. In some examples, controller 302 is embodied in a general purpose computer while in other examples, controller 302 is embodied in at least some of the components described throughout the present disclosure, such as within the base 152 and/or within some of the removably connected units.

For purposes of this application, in reference to the controller 302, the term "processor" shall mean a presently developed or future developed processor (or processing resources) that executes sequences of machine readable instructions (such as but not limited to software) contained in a memory. In some examples, execution of the sequences of machine readable instructions, such as those provided via memory 304 of control portion 300 cause the processor to perform actions, such as operating controller 302 to implement illumination generally, color illumination, and/or other functions, as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium, as represented by memory 304. In some examples, memory 304 comprises a computer readable tangible medium providing non-volatile storage of the machine readable instructions executable by a process of controller 304. In other examples, hard wired circuitry may be used in place of or in combination with machine readable instructions (including software) to implement the functions described. For example, controller 302 may be embodied as part of at least one application-specific integrated circuit (ASIC). In at least some examples, the controller 302 is not limited to any specific combination of hardware circuitry and machine readable instructions (including software), nor limited to any particular source for the machine readable instructions executed by the controller 302.

In some examples, user interface 240 (FIG. 9) comprises a user interface or other display that provides for the simultaneous display, activation, and/or operation of at least some of the various components, functions, features, and of control portion 300 and/or the various lighting arrangements (or non-lighting functions), as described throughout the present disclosure. In some examples, at least some portions or aspects of the user interface 240 are provided via a graphical user interface (GUI).

Figure 11:
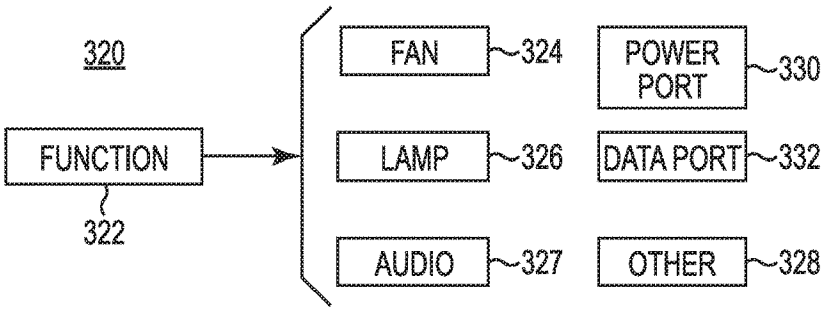
FIG. 11 is a block diagram schematically representing an array of functions, according to one example of the present disclosure.
Figure 14B:
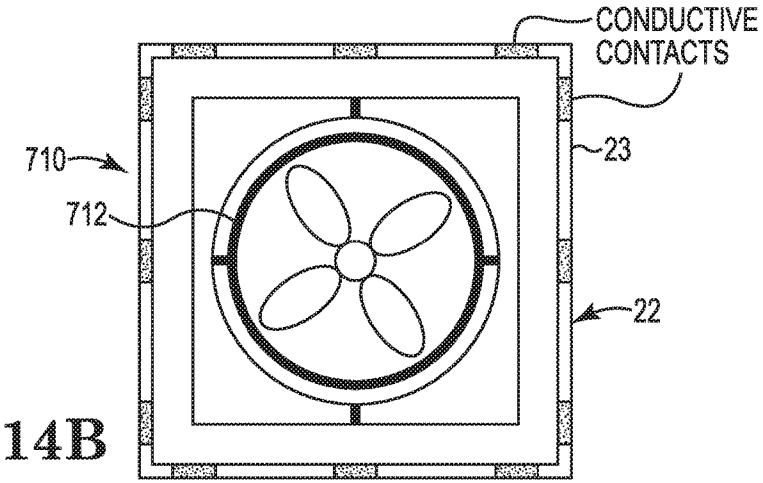
FIG. 14B is a front view schematically representing a fan unit, according to one example of the present disclosure.
Figure 14A:
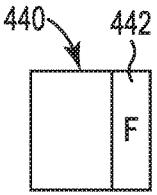
FIG. 14A is a block diagram schematically representing a fan unit, according to one example of the present disclosure.
Figure 15B:
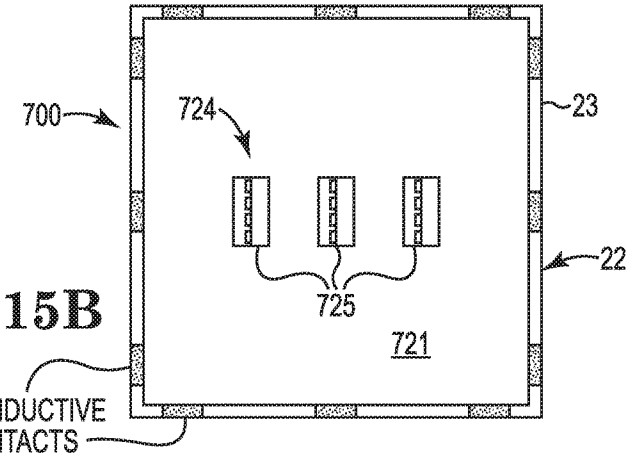
FIG. 15B is a front view schematically representing a multi-USB unit, according to one example of the present disclosure.

FIG. 11 is diagram 320 schematically illustrating some functions 322, according to one example of the present disclosure, implementable via the lighting systems, modules, components, etc. described herein. In some examples, a lighting unit (e.g. 22 in FIG. 1A, 162 in FIG. 4) may be modified to include a fan (e.g. 442 in FIG. 14A, 712 in FIG. 14B) to move air and as such fan function 324 (FIG. 11) may be implemented in user interface 240 (FIG. 9) to activate/deactivate the fan, control the fan speed, orientation, etc. As later described, FIGS. 14A and 14B provide further details regarding a fan implementable via fan function 324.

In some examples, a lighting unit (e.g. 22 in FIG. 1A, 162 in FIG. 4) may be modified to include a lamp (e.g. 412 in FIG. 12A) to provide significant illumination of the local ambient environment (e.g. serve as a desk lamp) and as such lamp function 326 in FIG. 11 may be implemented via user interface 240 (FIG. 9) to activate/deactivate the lamp, dim the lamp, control the orientation of the light emission, etc.

As further shown in the diagram 400 of FIG. 12A, in some examples an array 402 of additional units 410 are assembled together to vertically raise a lamp 412 to provide illumination for surfaces at least below and lateral to the lamp 412. In some examples, lamp 412 is fully pivotable (as represented via directional arrow A) through a 360 degree orientation (or portions thereof). In some examples, lamp 412 is implemented via LED elements. It will be understood that the assembly of units 410 are not solely limited to implementing a lighting function or lamp, and that in some examples, the assembly of units 410 is employed to implement other functions, such as a fan, audio, etc.

With further reference to FIG. 11, in some examples, a lighting unit (e.g. 22 in FIG. 1A, 162 in FIG. 4) may be modified to include an audio component (e.g. 432 in FIG. 13A, 702 in FIG. 13B) and as such audio function 327 may be implemented via user interface 240 (FIG. 9) to activate/deactivate the audio component, control the volume, etc.

In some examples, a power port control 330 and/or data port control 332 may be implemented via the user interface 240 (FIG. 9) and base 152 (FIG. 4) to enable control over power transmission (via at least element 422) in modified lighting unit 420 (FIG. 12B) and/or data transmission (via at least element 427) in modified lighting unit 425 (FIG. 12C), respectively.

In some examples, the power port control 330 and/or data port control 332 may be implemented via the user interface 240 (FIG. 9) and base 152 (FIG. 4) to enable control over power transmission in a unit 420 (FIG. 12B) which omits lighting functionality and/or control over data transmission in a unit 425 (FIG. 12C) which omits lighting functionality, respectively.

More generally speaking, in some examples the unit(s) 20 (or units 162) may embody a power unit 420 (FIG. 12B) and/or a data unit 425 (FIG. 12C) without including a lighting function. Stated differently, in some units (e.g. 20 in FIG. 1), power transmission comprises the sole function of the unit 420, such that data function and/or lighting functions are not provided. In some units, data transmission comprises the sole function of the unit 427, such that power function and/or lighting functions are not provided. In some units, both power transmission and data transmission are provided but no lighting function is provided.

As further described later in association with FIG. 21, a chain of such power units 420 may be formed via removable connection to form a dedicated power transmission tool. As further described later in association with FIG. 21, a chain of such data units 425 may be formed via removable connection to form a dedicated data transmission tool.

Figure 12D:
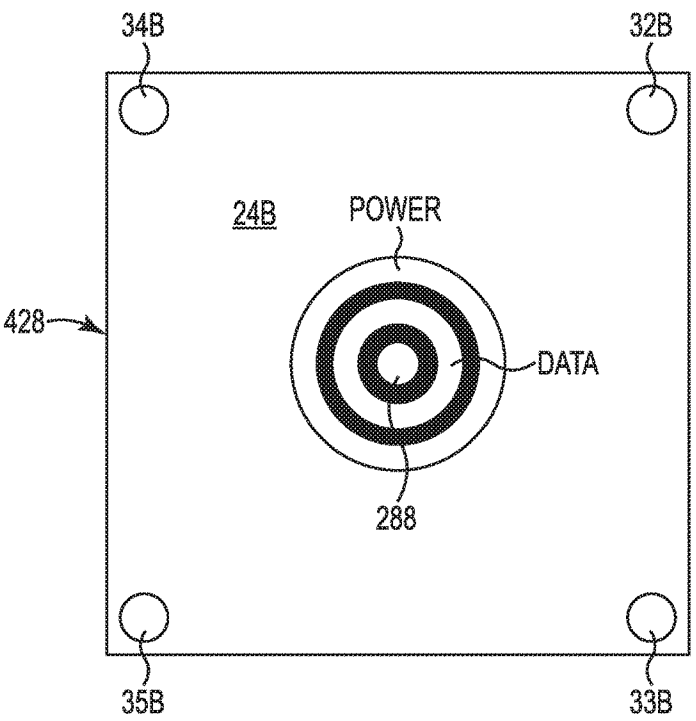
FIG. 12D is a side view of schematically representing a power and data interface of a removably connectable unit, according to one example of the present disclosure.
Figure 12B:
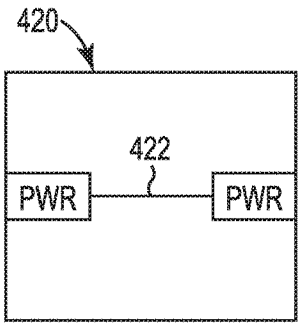
FIG. 12B is a block diagram schematically representing a power transmission unit, according to one example of the present disclosure.

FIG. 12D is top plan view schematically illustrating a contact interface 428 of a lighting unit, according to one example of the present disclosure. In some examples, contact interface 428 includes at least some of substantially the same features and attributes as the contact interfaces (arrangement of conductive contacts, etc.) of units 20, as previously described herein. However, contact interface 428 additionally includes a data-dedicated conductive ring (DATA) and a power-dedicated conductive ring (POWER) concentrically arranged relative to common conductor contact 28B (e.g. ground). These additional conductive rings enable transmission and reception of data and/or power through each similarly enhanced lighting unit (or non-lighting unit) to enable implementing functions instead of, or in addition to, lighting in one of the many configurable systems consistent with the present disclosure. In one aspect, the ring shape of the POWER function or DATA function ensure their implementation regardless of the rotational orientation of the respective face of a housing (of a lighting unit or non-lighting unit) when removably coupled relative to a similarly arranged face of an adjacent housing (of a lighting unit or non-lighting unit).

Figure 13B:
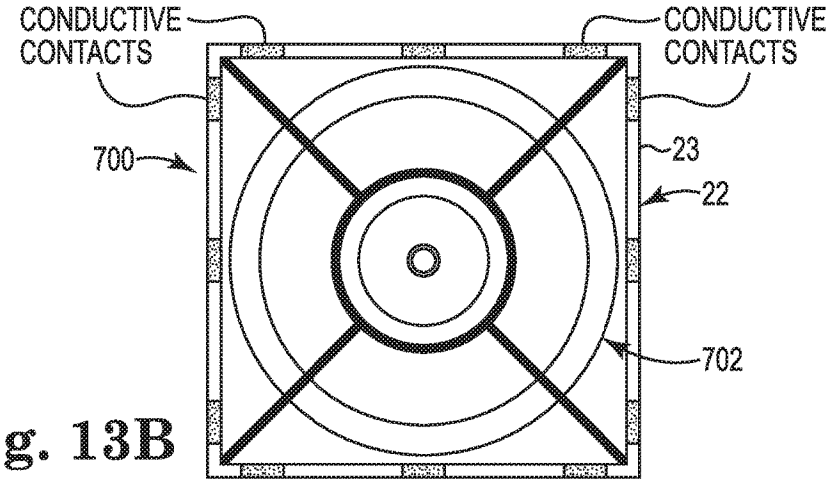
FIG. 13B is a front view schematically representing a speaker of an audio unit, according to one example of the present disclosure.
Figure 13A:
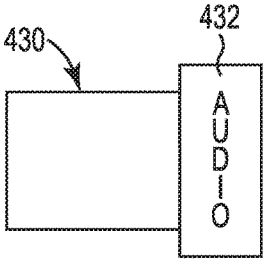
FIG. 13A is a block diagram schematically representing an audio unit, according to one example of the present disclosure.

FIG. 13A is a block diagram schematically representing an audio unit, according to one example of the present disclosure. As shown in FIG. 13A, the unit 440 comprises a housing incorporating an audio unit 432. FIG. 13B is a partial sectional view schematically representing one example implementation of an audio unit 700 comprising a housing 22 having an outer wall 23 with conductive contacts, such as in FIG. 1A, and containing a speaker 702. Accordingly, via such arrangements, one can readily attach an audio unit directly to a base or some part of a chain of removably connected units arranged in a desired configuration. It will be understood that, in some examples, at least some of such audio unit 440 omits lighting functionality.

In some examples, operation of the audio component is independent of any rotation of at least some of the removably connected units and/or independent of a change in lighting or change in other functions, such that such changes do not affect (e.g. deactivate, reduce intensity, etc.) the operation of the audio component, such as a powered speaker.

In some examples, control over audio unit 430, and/or audio data (e.g. music), may be communicated to audio unit 430 via any of the different data/communication pathways as described throughout the examples of the present disclosure.

FIG. 14A is a block diagram schematically representing a fan unit 440, according to one example of the present disclosure. As shown in FIG. 14A, the unit 440 comprises a housing incorporating a fan 442 (F). FIG. 14B is a partial sectional view schematically representing one example implementation of a fan unit 710 comprising a housing 22 having an outer wall 23 with conductive contacts, such as in FIG. 1A, and containing a fan 712. Accordingly, via such arrangements, one can readily attach a fan unit directly to a base or some part of a chain of removably connected units arranged in a desired configuration.

In some examples, such units omit a lighting function such that the fan provides the sole function of the unit.

In some examples, operation of the fan is independent of any rotation of at least some of the removably connected units and/or independent of a change in lighting or change in other functions, such that such changes do not affect (e.g. deactivate, reduce intensity, etc.) the operation of the fan component.

In some examples, control over fan unit 440 may be communicated to fan unit 440 via any of the different data/communication pathways as described throughout the examples of the present disclosure.

FIG. 15 is a side sectional view schematically illustrating a unit 450, according to one example of the present disclosure. In some examples, unit 450 includes a USB component 451 including at least one USB port 452A, 452B on opposite faces (454A, 454B) of the unit 450 and connected via connector 453. In some examples, unit 450 permits charging a device (e.g. phone, tablet, etc.) or sending/receiving data. Accordingly, in such examples, the USB component 451 (including USB ports 452A, 452B and connector 453) may be the sole function provided via the modular unit 450. In other words, in such examples unit 450 omits lighting functionality.

In some examples, unit 450 includes a lighting function and/or other functions, such as power, audio, etc.

In some examples, the USB ports 452A, 452B can be on non-opposing faces.

In some examples, unit 450, as well as any additional units connected to base 152 (FIG. 4) may employ additional conductive elements for transmitting and receiving power and/or data, as further shown in association with FIG. 12D. Accordingly, in some examples, a first face (e.g. 454A in FIG. 15) of the unit 450 communicates data and/or power via the contacts, such as in the example illustrated in FIG. 12D in which face 24B includes a contact interface for communicating data and/or power. A second face (e.g. 454B or another face other than 454A) of the unit 450 includes at least one USB port (e.g. 452B) to provide a USB-connectable interface to enable removable connection by a phone, tablet, etc. to send and receive data and/or power via the unit 450.

In some examples, the unit 450 includes multiple USB ports 725 available on at least two faces (e.g. 454A, 454B) of the housing 451 of the unit 450. One example of a multi-USB unit 700 is illustrated in association with at least FIG. 15B, in which a face 721 of a housing 700 of such a unit 450 includes an array 724 of USB ports 725.

Figure 15A:
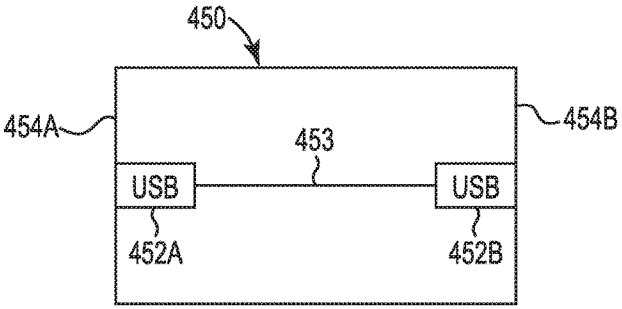
FIG. 15A is a block diagram schematically representing a USB unit, according to one example of the present disclosure.

In some examples, such an array 724 of multiple USB ports 725 is provided on at least two faces of a unit, such as faces 454A and 454B although it will be understood that the two faces need not be opposite of each other, as in FIG. 15A.

In some examples, such an array 724 of multiple USB ports can be provided on just one face (e.g. face 454B) of a unit 450, with the other face (e.g. 454A) having a power and/or data contact interface, in a manner similar to that described above in association with at least FIGS. 4, 12D, 16B.

In some examples, operation of a USB port is independent of any rotation of at least some of the removably connected units 20, 162 and/or independent of a change in lighting or change in other functions, such that such changes do not affect (e.g. deactivate, alter, etc.) the operation of the USB port or any controller associated therewith such that the operational changes of the USB component(s) are driven solely in relation to changes by a base and/or its controller or control portion.

Figure 12C:
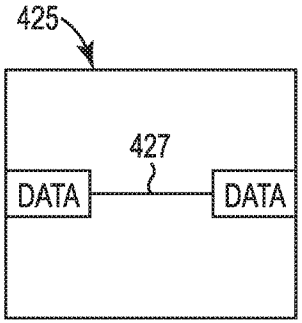
FIG. 12C is a block diagram schematically representing a data transmission unit, according to one example of the present disclosure.
Figure 12A:
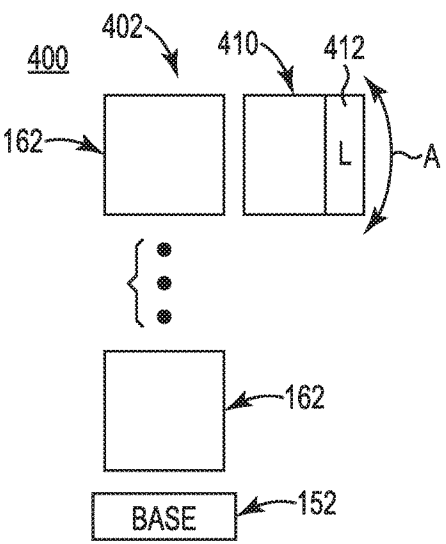
FIG. 12A is a diagram including a side view schematically representing a lamp arrangement, according to one example of the present disclosure.
Figure 16B:
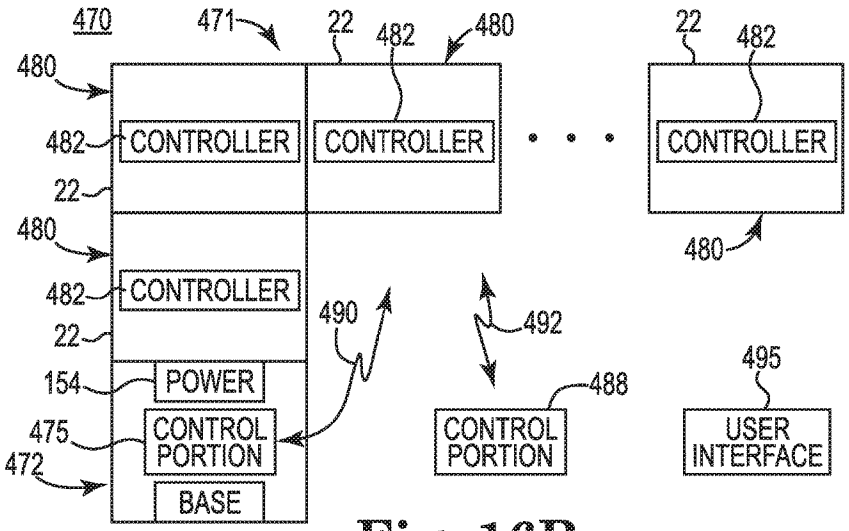
FIG. 16B is a block diagram schematically representing a controller network in association with removably connectable units, according to one example of the present disclosure.
Figure 16A:
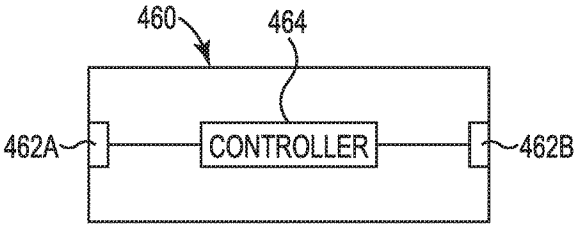
FIG. 16A is a block diagram schematically representing a controller in a removably connectable unit, according to one example of the present disclosure.

FIG. 16A is side sectional view schematically illustrating a unit 460, according to one example of the present disclosure, which includes a controller 464 to enable control over data and/or power available via contacts, connectors or ports 462A, 462B at opposite faces of unit 460. In some examples, the functions and elements of the controller 464 are combined with the functions and elements of units 420 (FIG. 12B) or 425 (FIG. 12C). In some examples, controller 464 comprises at least some of substantially the same features and attributes as control portion 300 and/or controller 302 as previously described in association with at least FIG. 10.

In some examples, unit 460 does not receive data via contacts (e.g. 32A, 32B, 32E, 33E, etc. in FIG. 1A) connectors or ports (e.g. ports 462A, 462B in FIG. 16), but instead unit 460 receives data wirelessly via controller 464, as shown in further detail in at least FIGS. 8-9 or FIG. 16B.

FIG. 16B is a diagram 470 including a block diagram schematically representing a system 471 of connectable units 480 communicating data wirelessly relative to a control portion, according to one example of the present disclosure. As shown in FIG. 16B, system 471 includes a base 472 including a power source 154 and comprising at least some of substantially the same features and attributes as base 152 of FIG. 4. Base 472 includes control functionality via control portion 475, which comprises at least some of substantially the same features and attributes as controller 156 (FIG. 4) along with control portion 475 having wireless communication capabilities as further described below.

As further shown in FIG. 16B, each unit 480 of system 471 includes at least some of substantially the same features and attributes as a unit 20 in FIG. 1A and/or unit 162, 182 in FIGS. 4-6B, such as having a housing 22, being removably connectable relative to other units 480 via magnetic contacts, sharing power via the contacts, etc. Accordingly, in some examples, each unit 480 includes lighting functionality (e.g. a LED array 27) as in association with at least FIGS. 1A-10. However, in some examples, at least some units 480, and potentially all units 480 omit such lighting functionality. In some examples, the unit 460 in FIG. 16A or at least some of the units 480 in FIG. 16B omits a lighting function, such as an LED array 27.

In some examples, a unit 480 comprises at least substantially the same features and attributes as unit 460 in FIG. 16A.

As further shown in FIG. 16B, each unit 480 includes a controller 482 having at least some of substantially the same features as controller 464 (FIG. 16A) or as controller 302 (FIG. 10) and/or control portion 300 (FIG. 10). Moreover, each controller 482 comprises at least some of the wireless communication functionality as wireless communication module 230 (FIG. 8) and/or data module 220 (FIG. 7). Accordingly, in some examples, via such controllers 482, data can be communicated wirelessly between control portion 475 in base 472 and the controller 482 within each of the units 480, as represented by wireless communication indicator 490.

In some examples, such wireless communication with the controller 482 in each unit 480 also can involve a control portion 488 external to, but cooperative with base 472, as represented via wireless communication indicator 492. In some such examples, the external control portion 488 cooperates with control portion 475. In other such examples, the external control portion 488 can replace the functionality of internal control portion 475 provided that external control portion 488 is communicatively coupled relative to base 472, whether wired or wirelessly.

In some examples, the external control portion 488 can be implemented via an external device such as a smart phone, tablet, phablet, smart watch, laptop computer, desktop computer, etc.

In some examples, system 470 includes a user interface 495 to facilitate user interaction with control portion 475 and/or control portion 488. In some examples, user interface 495 comprises at least some of substantially the same features and attributes as user interface 240 in FIG. 9, but also is not limited to such functionality.

Via the arrangement in system 470, data can be communicated wirelessly from a control portion to each unit 480 for individual control of the functionality of each unit 480, regardless of the particular type of functionality of the particular unit.

In some examples, via this arrangement, at least some units 480 may communicate at least some data to each other independent of control portion 475 and/or control portion 488. Accordingly, in some examples, the system 470 can be viewed as providing a peer-to-peer or node-to-node network of controllers 482 (in each unit 480) to facilitate any desired functionality. In some examples, such node-to-node relationships may be used solely to transfer data from unit 480 to unit 480 without performing other functionality, such as lighting, audio, etc.

It will be understood that, in some such examples, the magnetic contacts by which the different units 480 are removably connected to each other are used solely to transmit power and for adhesion, and therefore, not to communicate data.

Figure 17B:
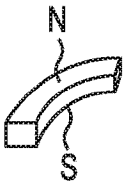
FIG. 17B is a diagram schematically representing a magnetic contact element, according to one example of the present disclosure.
Figure 17A:
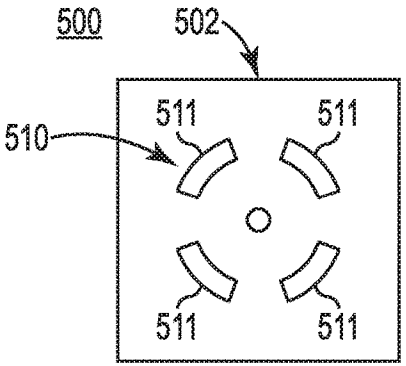
FIG. 17A is a side view schematically representing a contact interface, according to one example of the present disclosure.

FIG. 17A is a diagram 500 including a top plan view schematically illustrating a contact interface 502 of a lighting unit or non-lighting unit, according to one example of the present disclosure. As shown in FIG. 17A, instead of placing conductive contacts (e.g. 32A, 33A, 34A, 35A in FIG. 1A) at the corners of a face of a housing 22 of a lighting unit 20, each electrically independent conductive contact (e.g. 32A, 33A, 34A, 35A) is formed in the shape of an annular ring portion 511 with each ring portion 511 defining a magnetically attractable ring segment (FIG. 17B). Together, the segments 511 generally define annular ring shaped.

Figure 18:
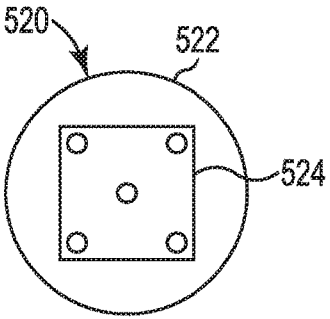
FIG. 18 is a side view schematically representing a contact interface, according to one example of the present disclosure.

FIG. 18 is a diagram including a top plan view schematically illustrating a contact interface 524 of a unit 20, according to one example of the present disclosure. As shown in FIG. 18, the rectangular shape of the contact interface 524 does not match the generally circular face 522 of the associated unit 20.

Figure 19C:
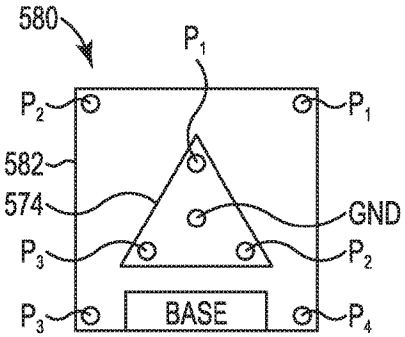
FIG. 19C is a side view schematically representing a contact interface, according to one example of the present disclosure.
Figure 19B:
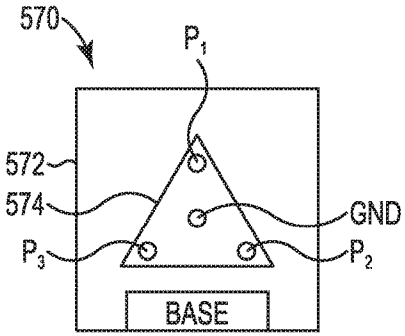
FIG. 19B is a side view schematically representing a contact interface, according to one example of the present disclosure.
Figure 19A:
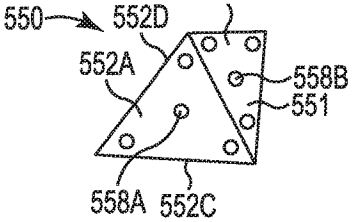
FIG. 19A is a perspective view schematically representing a tetrahedron-shaped unit, according to one example of the present disclosure.

FIG. 19A is a perspective view schematically illustrating a tetrahedron-shaped housing 551 of a lighting unit 550, according to one example of the present disclosure. As shown in FIG. 19A, housing 551 includes four faces 552A-552D, each defining an equilateral triangle. In some examples, lighting unit 550 includes at least some of substantially the same features and attributes as unit 20 as previously described in association with FIGS. 1A-18, except for having just three conductive contacts per face 552A, 552B, 552C, 552D and have four faces instead of six, along with a single common conductor.

FIG. 19B is top plan view of a control contact interface 574 of a base 570, according to one example of the present disclosure. In some examples, base 570 comprises at least some of substantially the same features and attributes as base 152 as previously described in association with at least FIGS. 4A-9, except for providing a generally triangular-shaped, control contact interface 574 instead of the generally rectangular-shaped control contact interface of base 152 in order to match the generally triangular-shaped faces of unit 550 (FIG. 19A).

FIG. 19C is a top plan view of a control contact interface 582 of a base 580, according to one example of the present disclosure. In some examples, base 570 comprises at least some of substantially the same features and attributes as base 152 as previously described in association with at least FIGS. 4A-9, except for combining the generally triangular-shaped control contact interface 574 of FIG. 19B with the generally rectangular-shaped control contact interface of FIG. 4-6A. This arrangement enables use of this base 580 interchangeably with units 20 having rectangular-shaped contact interfaces (e.g. FIG. 1) or with units 20 having triangular-shaped contact interfaces (e.g. 19A).

In some examples, an adapter unit can be used to facilitate a transition from one shaped unit to differently shaped unit, such as from a cube-shaped unit to a tetrahedron-shaped unit (550 in FIG. 19A).

Figure 20:
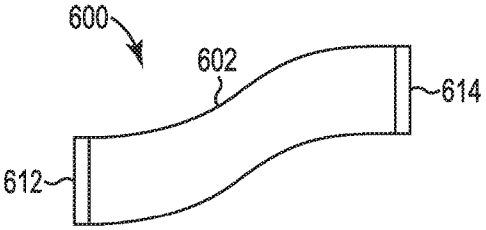
FIG. 20 is a side view schematically representing a tubular-shaped housing of a connectable unit, according to one example of the present disclosure.

FIG. 20 is side plan view schematically illustrating a lighting unit 600 having resilient tube-shaped housing 602, according to one example of the present disclosure, which is flexibly movable into different shapes while providing two contact interfaces 612, 614 at opposite ends of the housing 602. In some examples, contact interfaces 612, 614 comprises at least some of substantially the same features and attributes as the conductive contact interfaces defined by the faces 24A-24F of housing 22 of unit 20, or as at least in FIG. 12D, 18, 19.

FIG. 21 is perspective view schematically illustrating an assembly 650, according to one example of the present disclosure. FIG. 21 illustrates just one example of many examples in which multiple units 652 (e.g. 20 in FIG. 1 A) may be releasably connected together into one three-dimensional object and which may be reconfigured at any time by simply adding or removing individual units from their particular location. In particular, at least some of the units 652 in the assembly 650 include the type of contact interfaces as described in the various examples throughout the present disclosure.

In some examples, units 652 are supported and/or at least partially controlled via base 955, which comprises at least some of substantially the same features and attributes as base 152 (FIG. 4-6B) and/or base 472 (FIG. 16B).

It will be understood that in some examples, at least some of the units 652 (or even all of the units 652) provide lighting functionality while in some examples at least some (or even all) of the units omit lighting functionality.

Moreover, in some examples at least some of the units 652 (or even all of the units 652) provide one or more of the other types of non-lighting functionality.

In some examples, at least some of the units include both lighting functionality and one of more types of non-lighting functionality, such as power, data, audio, fan, etc.

In some examples, by connecting multiple units 652 together an assembly 650 of units 652 may function as a portable, reconfigurable, shape-changeable power transmission tool, whether the units 652 are lightable (or color changeable) or not. Accordingly, in some such examples, each unit 652 omits other types of functionality (e.g. lighting, data, etc.) such that the connected assembly or chain of units 652 has the sole function of transmitting power from the base 955 outward for access by an external device, upon its removably coupling to an end unit 652 (or an intermediate unit 652) of the chain. In some examples, the external device can be removably coupled to receive power via the magnetic contacts of the unit 652 and/or other connection means, such as but not limited to a USB port (e.g. FIGS. 15A, 15B) on the unit 652.

In some examples, by connecting multiple units 652 together as an assembly 650 of units 652 (FIG. 21), the arrangement provides a portable, reconfigurable, shape-changeable data transmission tool, whether the units 652 are lightable (or color changeable) or not. Accordingly, in some such examples, each unit 652 omits other types of functionality (e.g. lighting, etc.) such that the connected assembly or chain of units 652 has the sole function of transmitting data from the base outward for access by an external device, upon its removably coupling to an end unit 652 (or an intermediate unit 652) of the chain. In some examples, the external device can be removably coupled to receive data via the magnetic contacts of the unit 652 and/or other connection means, such as but not limited to a USB port (e.g. FIGS. 15A, 15B) on the unit 652.

In some examples, an assembly 650 of units 652 may provide a node-to-node network in which at least some the units 952 of the assembly communicate data wirelessly independently of, or in cooperation with, other units 952 in a manner similar to the example arrangement in FIG. 16B.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A lighting system comprising:

a plurality of lighting units with each lighting unit including a multi-color light source to produce four different color lights including a white color light and three different primary color lights and combinations thereof; and a cube-shaped housing to enclose the multi-color light source, the housing including:

six faces; and a first contact interface on each face and having four power-transmissible conductive contacts arranged in a square pattern in which each respective one of the four power-transmissible conductive contacts is located adjacent a corner of the respective face of the cube-shaped housing and each respective one of the four power-transmissible conductive contacts corresponds to a respective one of the four different color lights of the multi-color light source, such that upon application of power to the respective conductive contact, a corresponding color is emitted from the multi-color light source, wherein at least some of the conductive contacts are magnetically attractable, and wherein adjacent lighting units are releasably couplable relative to one another via magnetic attraction of the respective conductive contacts, and wherein the plurality of lighting units comprises a series of lighting units, and a color emitted via one of the respective lighting units is at least partially dependent on which conductive contacts of a prior lighting unit are being powered.

2. The lighting system of claim 1, wherein each conductive contact on each respective face is surrounded by a dielectric material.

3. The lighting system of claim 1, wherein each respective face is formed of a generally electrically insulative material to surround the respective conductive contacts.

4. The system of claim 1, wherein each respective face of the cube-shaped housing comprises a ground conductive contact located at a center of the square pattern.

5. The system of claim 1, wherein the first contact interface defines an area less than an area of the face.

6. The system of claim 1, wherein the multi-color light source comprises a white LED portion.

7. The system of claim 6, wherein the multi-color light source comprises a LED package including at least one of a red light LED portion, a green light LED portion, and a blue light LED portion.

8. The system of claim 7, wherein the multi-color light source is located adjacent a central portion within the interior of the housing, generally equidistant to the corners of the housing.

9. The system of claim 8, wherein each respective different LED portion comprises an oppositely extending pair of leads which extend to two opposite corners of the housing.

10. The system of claim 1, wherein the multi-color light source comprises a single LED package to produce at least one of red light, green light, and blue light.

11. The system of claim 1, wherein the multi-color light source comprises a red LED, a green LED, and a blue LED, each separate from each other.

12. The system of claim 1, wherein the emitted color is at least partially dependent on the rotational position of the one or more subsequent lighting units relative to the rotational position of the prior lighting unit.

13. The system of claim 1, comprising:

a base having a control contact interface having four individually addressable conductive power contacts arranged in a second pattern which at least matches the square pattern of the first contact interface and in which each respective one of the conductive power contacts corresponds to a respective one of the four different colors of the multi-color light source, such that upon application of power via the base to the respective conductive power contacts, power will be transmitted to the corresponding contacts of the first contact interface of the housing of the lighting unit, wherein at least some of the conductive power contacts are magnetically attractable relative to the magnetically attractable conductive contacts of the first contact interface of the lighting unit.

14. The system of claim 13, wherein the base includes a power management portion to determine, in association with a controller, a variable intensity of power selectively applied to each conductive contact of the control contact interface of the base to thereby control, in at least the lighting unit coupled to the base, which respective conductive contacts of the respective face coupled to the base will receive power and the variable intensity of power applied to those conductive contacts receiving power.

15. The system of claim 13, wherein the base includes a power management portion.

16. The system of claim 15, wherein the base includes a communication portion to communicate with at least an external controller to control power applied to the conductive contacts of the control contact interface.

17. The system of claim 1, wherein the cube-shaped housing comprises eight corners with each respective corner comprising a junction of a corner portion of each of three different faces of the cube-shaped housing, and wherein the power-transmissive conductive contact of each corner portion of the respective three different faces at one respective corner of the housing all correspond to a single one of the respective colors of the multi-color light source.

18. The system of claim 17, wherein each pair of opposite corners of the cube-shaped housing have conductive contacts at the respective corner portions of the respective faces at the opposite corners which are electrically connected to a single one of the respective colors of the multi-color light source.

19. The system of claim 1, wherein an exposed portion of all the power-transmissive conductive contacts on a respective face of the cube-shaped housing have a first magnetic orientation and the exposed portion of all the power-transmissive conductive contacts on an opposite respective face of the cube-shaped housing have an opposite second magnetic orientation.

20. A lighting system comprising:

a lighting unit including:

a multi-color light source; and a housing to enclose the light source and including:

a plurality of faces oriented in different directions; and a first contact interface on each face and having a plurality of conductive contacts arranged in at least a first pattern in which each respective one of the conductive contacts on a respective face corresponds to a respective one of a plurality of different colors of the multi-color light source, such that upon application of power to the respective conductive contact, a corresponding color is emitted from the multi-color light source, wherein at least some of the conductive contacts are magnetically attractable, a base having a control contact interface having an array of individually addressable conductive power contacts arranged in a second pattern which at least matches the first pattern of the first control interface and in which each respective one of the conductive power contacts corresponds to a respective one of a plurality of different colors of the multi-color light source, such that upon application of power via the base to the respective conductive power contact, power will be transmitted to the corresponding contact of the first contact interface of the housing of the lighting unit, wherein at least some of the conductive power contacts are magnetically attractable relative to the magnetically attractable conductive contacts of the first control interface of the lighting unit, and wherein the second pattern of the control contact interface is cooperable with the first contact interface and with a second contact interface of a different lighting unit having a third pattern of conductive contacts, wherein the third pattern has a shape different than a shape of the first pattern of conductive contacts.

* * * * *